United States Patent [19]

Dauvergne

[11] 4,359,951

[45] Nov. 23, 1982

[54] LOW PROFILE PORTABLE POWER PLANT

[76] Inventor: Hector A. Dauvergne, P.O. Box 884, San Leandro, Calif. 94577

[21] Appl. No.: 228,472

[22] Filed: Jan. 26, 1981

[51] Int. Cl.[3] ..... F23B 7/00

[52] U.S. Cl. ..... 110/234; 122/15; 122/213; 122/DIG. 10

[58] Field of Search ..... 110/234, 209; 122/15, 122/213, 214, DIG. 10, 4 R

[56] References Cited

U.S. PATENT DOCUMENTS

| | | | |
|---|---|---|---|
| 336,370 | 2/1886 | Zerr et al. | 110/209 |
| 1,001,336 | 8/1911 | Barrus | 110/209 |
| 3,776,153 | 12/1973 | Stewart | 110/234 X |
| 4,257,338 | 3/1981 | Chasek | 110/234 X |

*Primary Examiner*—Edward G. Favors

*Attorney, Agent, or Firm*—Bielen and Peterson

[57] ABSTRACT

A portable power plant for combustion of solid fuels with contiguous generation of steam and power, wherein the plant is constructed with a low-profile, contiguous dual stage combustion chamber and adjacent dual stage boiler chamber for controlled pyrolysis burning of low B.t.u. solid fuels, the plant having controlled gas and air flow for phased burning and cycling of combustion products with capture and utilization of system generated heat for air and fuel preheating, the plant being constructed for vehicle carriage for mobility to the fuel site.

10 Claims, 2 Drawing Figures

LOW PROFILE PORTABLE POWER PLANT

BACKGROUND OF THE INVENTION

This invention relates to a solid fuel power plant of the type heretofore considered large for a mobile or portable plant. The present plant design utilizes features of the burner described in my U.S. Pat. No. 4,167,909, entitled Solid Fuel Burner, issued Sept. 18, 1979, and the boiler system described in my Patent Application, Ser. No. 050,621, entitled Free-Expansion Boiler with Replaceable Heat Exchanger Tubes, filed June 21, 1979.

As fuel costs escalate, it has become apparent that a substantial cost in the operation of a power plant has been the transportation costs in bringing the solid fuel to the plant for combustion and generation of steam and/or power. Often the class of fuel used to transport solid fuel is of a higher grade or in a more refined state than the fuel being transported. For example, contemporary trucks and trains utilize refined diesel fuel for moving burnable waste material or coal ores to the plant and removing ash from the plant, adding to the economic disadvantage of fixed site power plants. Furthermore, power plants are conventionally designed to operate on high Btu fuel, often necessitating careful selection of waste materials, ores and/or the preconditioning of wastes and partial refining of ores. Again, such preparation and refining conventionally utilizes a higher grade of fuel to accomplish the necessary processing than the substances being processed. The economic realities of such systems are self evident.

The advantages of the invented portable power plant are principally that it can be moved to the sites of the solid fuel and that it can consume solid fuel in a low Btu state.

For example, after a forestry operation there may be considerable slash and sawdust at the cutting site which is useable as fuel, but of such low value as to be insufficient to justify the expense of hauling to a fixed power plant. Also, the nearest power plant may be unable to utilize such a fuel. Because the waste material would be limited in quantity, and is generated only periodically, it is generally discarded or burned on site, contributing to environmental pollution. A portable power plant transported to the site would ideally consume the material, produce power with a minimum of pollution, and then be relocated elsewhere.

As a further example, in utilization of limited quantities or poor quality coal, it may be more efficient to move the plant to the ore body, exporting electrical power than to haul or refine the ore off site. Similarly, in large remote coal fields, local generation of steam and electrical power from low quality fuel material, otherwise discarded, would provide the energy needs for low cost, on site refining of select coal for export, thereby avoiding transportation of unrefined coal with included ash and moisture, to a distant refining plant or power plant.

Other advantages in a mobile or transportable power plant will become apparent on a detailed consideration of the preferred embodiment.

SUMMARY OF THE INVENTION

The solid fuel power plant of this invention comprises a portable energy system designed to generate steam and/or electrical power from solid fuels of a moderate or low grade. The power plant is constructed as an integrated system that is self-contained and of sufficiently compact size and low weight that it may be mobile or portable and transported by conventional truck and rail methods.

Key to the mobile or portable feature is a contiguous, dual-level, combustion and heat exchange configuration which enables the plant to maintain a low profile suitable for road or rail systems. While the portable power plant utilizes burner concepts and boiler concepts of the above referenced patent and application, the present plant integrates these concepts into an efficient system.

The power plant is constructed with a dual stage combustion unit having an upper chamber with a primary bed onto which solid fuel is continuously deposited and a lower chamber with a secondary bed onto which substantially combusted residue falls for classified removal from the unit.

The primary bed includes a grate through which the substantially combusted material drops to a separation screen at the lower bed where the residue is divided into rock and ash for removal and recovery as building material.

In the upper chamber the solid fuel is incompletely combusted producing volitile gases and particles including carbon monoxide, carbon dioxide, carbon black, unburned hydrocarbons, and other oxides. The volitiles are produced at a temperature in the area of 1000° C. to prevent the formation of nitrogen oxides. These volitiles are diverted to the upper level of a dual level boiler chamber. The boiler chamber is divided into an upper heat exchange chamber and a lower heat exchange chamber by a horizontal baffel. The volitiles are drawn and/or blown through the upper chamber and returned to the lower combustion chamber where they are further combusted by a stoichiometric excess of oxygen, preferably in the form of preheated air. The secondary combustion generates fully combusted volitiles at a temperature in the area of 1400° C. While some nitrogen oxides are formed, the relatively low temperature maintains such to a minimum. The further combusted volitiles are drawn and/or blown through the lower heat exchange chamber and exhausted.

A plurality of replaceable boiler cartridges are positioned with a series of boiler drums arranged above the upper heat exchange chamber with vertically disposed, free expansion tubes penetrating both the upper and lower heat exchange chambers for the generation of steam.

The steam is collected in the drums and delivered to an adjacent power room having a turbine and electrical generator for the production of electricity. Take-off valves allow steam to be removed prior to or subsequent to the passage of the steam through the turbine for use as desired by the user, for example, in collateral refining, processing or heating operations. A system condenser returns the steam to a liquid state for recycling.

To maximize the system efficiency, heat losses normally occurring are substantially recovered by an air circulation system which preheats the air used in the combustion process.

Because the plant is designed as a controlled pyrolysis unit, a control system closely monitors and regulates the operation controlling fuel feed rates, flow of combustion volitiles and flow of air. Additionally, steam and power generation are regulated to the user's demands. Because of current state of the art in electrical load handling and power distribution, electrical energy generated can be delivered to the user in the form desired, or fed into a pre-existing power network of a primary electrical supplier.

These and other advantages will become apparent on a consideration of the preferred embodiment described hereafter.

DETAILED DESCRIPTION OF THE PREFERRED EMBODIMENT

Figure 1:
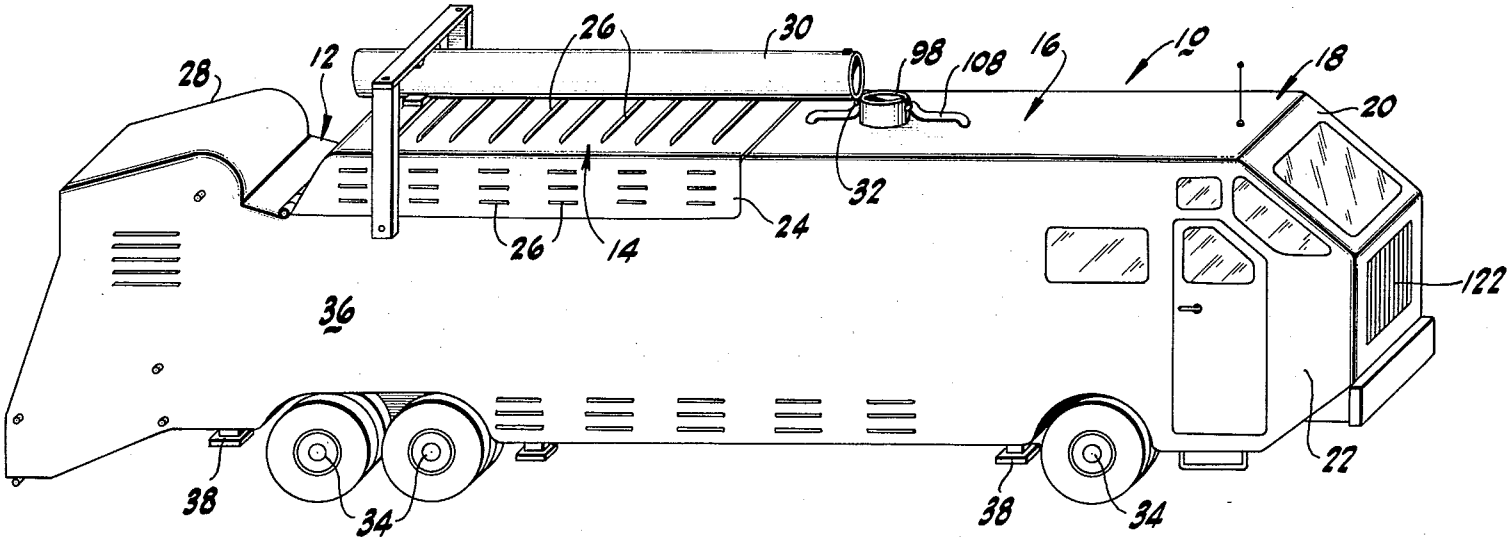
FIG. 1 is a perspective view of the portable power plant in the form of a mobile unit.

Referring to FIG. 1, a self-contained mobile power plant vehicle 10 is shown. The power plant vehicle 10 includes a burner section 12, a boiler section 14, a power generation section 16, and a control room 18. The control room 18 is a part of the cab 20. The vehicle 10 includes a diesel engine compartment 22 to provide conventional mobility to the vehicle. Alternately, a power plant can dispense with a vehicle cab and be designed for integral trailer mounting or as a loadable facility for road or rail transport. An advantage of the inclusion of a diesel engine with the plant system is the ability to integrate the engine into the power plant operation when not used for transport service, enabling efficient startup and emergency backup to the plant.

To achieve power generation in the quarter to half megawatt range the vehicle would be designed as an extra wide vehicle (ten to twelve feet), necessitating special, but not impossible, moving considerations.

Because the walls of the burner and heat exchange chambers are constructed of plate metal and do not require fire brick, the overall weight is minimized and maintained at a transportable level.

The power plant vehicle 10 of FIG. 1 includes a lightweight, removable cowling 24 which provides a cover to boiler drums contained thereunder. Operation is not affected to any substantial extent by removal of the cowling as necessary during replacement of one or more boilers. The cowling, however, provides a streamline effect to the vehicle and functions as an initial heat retention jacket with filtered vents 26 through which filtered air is drawn for initial preheat in the boiler drum region.

A second cowling 28 at the burner section 12 of the plant provides a cover for the discharge end of a solid fuel supply conveyer, described in greater detail with reference to FIG. 2, and minimizes heat loss by allowing captured heat to preheat incoming solid fuel.

A collapsible exhaust stack 30 folds to an incline position by a hinge connection 32, as shown in FIG. 1, during periods of transport. In emergency situations the hinge connection can be severed for removal of the stack where necessary for low clearance situations.

Externally, the power plan vehicle is conventionally formed with a multi-axle wheel support 34 designed for the load and a lightweight sheet metal hull 36, which not only provides a stream-line external protective shell, but functions as a jacket to reduce skin temperatures and collect internal radiant heat which flows to the top cowling 24 for mixing with incoming air for eventual delivery to the combustion chambers of the burner. As is common with similar apparatuses, the vehicle is provided with hydraulic stanchions 38 which are extended to ground contact during stationary operations to remove the weight of the vehicle from the wheel support 34.

Figure 2:
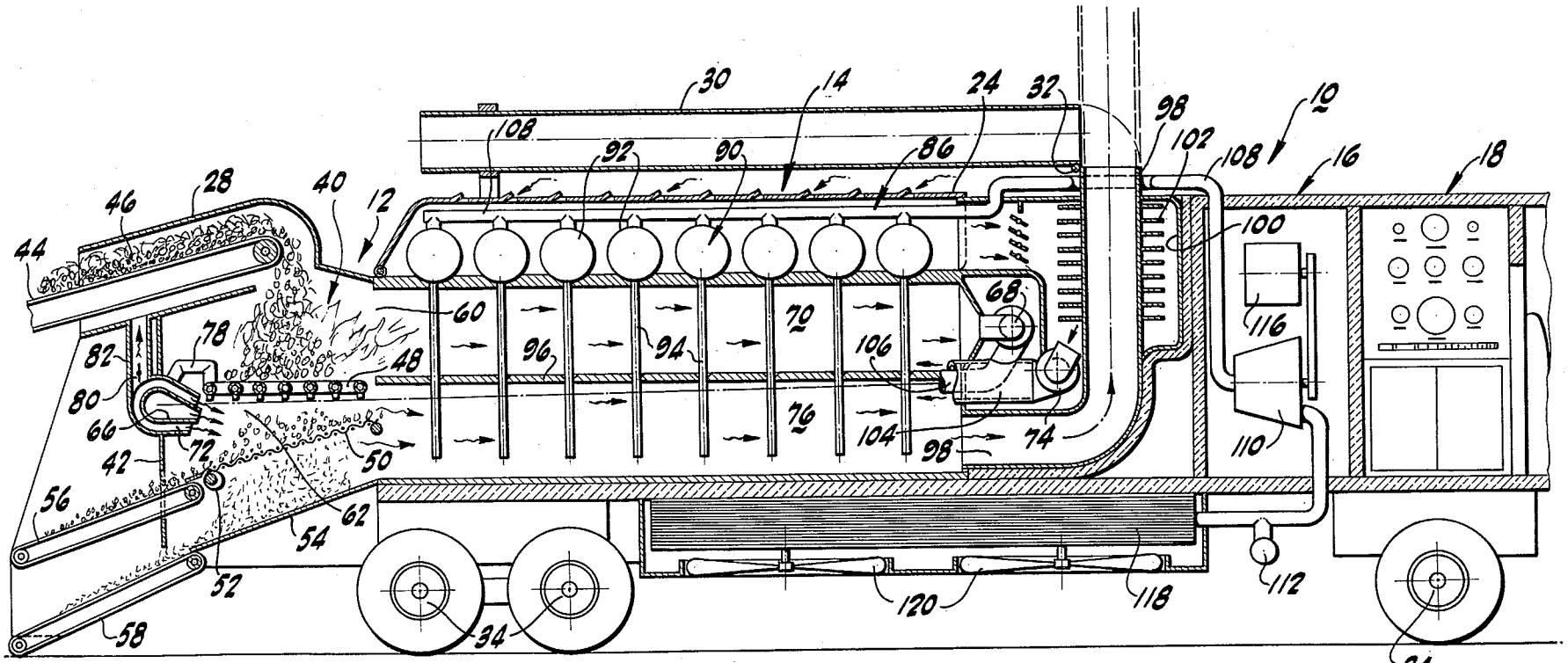
FIG. 2 is a schematic cross sectional view of the mobile unit of FIG. 1.

Referring now to FIG. 2 where the internal components are schematically illustrated, the previously designated vehicle sections are apparent from the defined components.

The burner section 12 includes the two stage burner 40 which is constructed with an outer steel plate housing 42 capped by the conveyor cowling 28. A belt conveyer 44 is erected with the discharge end within the cowling for preheat of continuously supplied fuel material such as the low Btu value coal ore 46 depicted. The burner includes a hollow tube grate 48, which supports a burning ore bed during the initial stage combustion. Substantially combusted fuel residue drops by gravity or mild agitation to a lower sloped screen 50 where any remaining combustibles are oxidized. The screen in addition to functioning as a secondary bed, classifies the residue as to rock or large particle residue and fine ash which falls by agitation of the screen by an agitator 52 to a final sloped base 54. Upper and lower discharge conveyers 56 and 58 remove the rock and ash, respectively, for disposal or storage as building material.

The hollow grate 48 defines the division between an upper combustion chamber 60 and a lower combustion chamber 62. The hollow nature of the grate 48 allows lighter weight materials to be used and provides a maintained cooling of the grate and a final pre-heat of air which circulates through the grate and out holes 64 on the underside of the tubular grate for directed distribution in the lower combustion chamber 62.

Combustion in the upper chamber 60 is air deficient such that the volatile products of combustion can be cycled to the lower chamber 62 for complete combustion, thereby allowing for a two-stage, delayed burning that enables close temperature control and a minimization of indesirable oxides of nitrogen and other exotic deleterious compounds formed at high combustion temperatures.

The partially combusted volitiles are introduced to the lower chamber through a flue opening 66 under positive pressure controlled by a blower 68 located behind the flue opening or as preferred, at the end of the upper heat exchange chamber 70.

Similarly, air (in addition to that flowing through the grate), is introduced to the lower chamber through a vent opening 72 under positive pressure controlled primarily by a blower 74 located behind the vent opening or as preferred, at the ends of the upper and lower heat exchange chambers 70 and 76. In the embodiment shown, the vent opening 72 has a nozzle configuration around the flue opening for insuring a combustion mix of the air and unburned volitiles. Part of the air is routed through a by-pass conduit 78 to the grate 48. Further, to enable immediate control of the air discharge, air may be shunted by a flap valve 80 through a conduit 82 to the area under the conveyer cowling 28 for preheat of the ore. In this manner, air that has been subjected to the preheat process as described hereafter is not wasted, but if in excess, is transferred to ore-preheat. While not an essential aspect of the present invention, the air preheat circuit as described hereafter is important in conserving combustion generated energy, thereby maximizing system efficiency.

The dual level boiler unit 86 adjacent the two-stage dual lever burner unit 40 is made possible by the unique boiler cartridges 90 utilized for generation of steam from the burner generated heat. The boiler cartridges 90 are constructed with drums 92 having depending, free-expansion boiler tubes 94 which, because of their ability to expand independent of one another or of the drum, can be exposed to different temperatures and temperature gradients. This characteristic allows the boiler unit 86 to be separated into its upper and lower levels, 70 and 76, divided by a horizontally disposed baffel 96.

The further combusted volitiles in the lower combustion chamber are of a higher temperature than the partially combusted volitiles of the upper combustion chamber. These further combusted volitiles are subjected to a stoichiometric excess of air and are completely combusted when blown into the adjacent lower heat exchange chamber. Thus, each tube experiences a different temperature at its upper and lower ends. The boiler cartridge 90 is described in detail in the referenced patent.

Because the volitiles are blown through the lower chamber 76 and drawn through the upper chamber, the slightly negative pressure of the upper chamber and slightly positive pressure of the lower chamber allows the baffel to be constructed with loose tolerances to aid replacement of removed cartridges, which would be more difficult were the baffel a seal between the upper and lower chambers. The pressure differential allows seepage of higher temperature gases from the lower chamber to the upper chamber which inhibits deposit of soot on the baffel. Because of the two-stage burning process, relatively little ash is deposited in the boiler chamber.

The completely combusted gases are exhausted through a flue 98 at the end of the lower chamber 76. Around the flue 98 is a heat exchanger jacket 100 which provides a pre-heat boost to the incoming air drawn through the top cowling 24 over the boiler drums 92. The preheat is enhanced by heat fins 102 on the flue 98. Because flue gases are being blown out and therefore, do not need to maintain a high temperature for discharge, other means such as heat pipes can be used to extract as much heat as possible from the escaping gases.

The hot air within the jacket is drawn by the air blower 74 and blown through an air conduit 104 to the vent opening 72 at the lower burner chamber 62.

The partially combusted volitiles of the upper combustion chamber 60 are drawn through the upper heat exchange chamber 70 by the blower 68 and blown through a flue conduit 106 to the flue opening 66 at the lower combustion chamber. To minimize heat loss in the partially combusted volitiles and thereby reduce soot deposit in the conduit, the flue conduit 106 is concentrically positioned within the air conduit 104. Any thermal losses in the volitiles are recovered by the already hot air in the surrounding air conduit during the return path to the burner. A dual return system with conduits along each side of the boiler chamber is desirable to allow for complete clean-out of the flue conduit under reduced capacity, rather than shut-off conditions.

The boiler cartridges are appropriately interconnected with shut-off and disconnect piping systems 108 to allow individual cartridges to be removed without system shut-down. The piping systems 108 deliver steam to the turbine 110 and/or to the steam outlet 112 as directed from the control room 18. The turbine is connected to a generator 116 for generation of electricity as required. Spent steam is returned to a condenser and water storage reservoir 118 located under the boiler chamber. The condenser has appropriate fans 120 and heat exchange circuits (not shown), to return the spent steam to a water state for reuse in steam generation as required.

The control room includes conventional and state of the art equipment for monitoring and regulating the operation of the system. Because the equipment is complex, but nevertheless readily available, it is not herein described in detail as it is only a collateral feature to the arrangement of combustion and heat exchange components which comprises the crux of the described invention. Similarly, the diesel powered engine (not shown), and the conversion system for use of the engine as a generator during plant start-up are not described in detail as such are conventional and well known in the art.

By monitoring and carefully regulating the combustion process and delivery systems, the operation can be optimized with regard to energy production and pollution reduction.

What is claimed is:

1. A low-profile solid fuel steam generation plant comprising in combination:

a. a combustion unit having:

(1) a first combustion chamber with a solid fuel bed for preliminary combustion of solid fuel, wherein incompletely combusted volitiles are generated within said first chamber;

(2) a second combustion chamber with an ash bed for complete combustion of combustible residuals of the solid fuel deposited from the first combustion chamber;

(3) means for depositing solid fuel on said solid fuel bed;

(4) means for cycling incompletely combusted volitiles from said first combustion chamber to said second combustion chamber wherein the volitiles are completely combusted, and (5) means for exhausting completely combusted volitiles; and b. a boiler unit contiguously arranged with respect to said combustion unit, said boiler unit having;

(1) at least one boiler drum with heat exchange tubes for generation of steam;

(2) a first heat exchange chamber, wherein said tubes of said boiler are exposed in part, said means for cycling incompletely combusted volitiles including means for cycling said volitiles through said first heat exchange chamber before cycling to said second combustion chamber, and (3) a second heat exchange chamber wherein said tubes of said boiler are exposed in part, said means for exhausting completely combusted volitiles including means for exhausting said volitiles through said second heat exchange chamber;

wherein said first heat exchange chamber is constructed and arranged directly above said second heat exchange chamber, wherein said tubes are continuous and pass from said first heat exchange chamber to said second heat exchange chamber.

2. The solid fuel plant of claim 1 wherein said first combustion chamber is constructed and arranged directly above said second combustion chamber whereby residuals of the solid fuel drop from said fuel bed to said ash bed during combustion.

3. A low-profile solid fuel steam generation plant comprising in combination:

a. a combustion unit having:
(1) a first combustion chamber with a solid fuel bed for preliminary combustion of solid fuel, wherein incompletely combusted volitiles are generated within said first chamber;
(2) a second combustion chamber with an ash bed for complete combustion of combustible residuals of the solid fuel deposited from the first combustion chamber;
(3) means for depositing solid fuel on said solid fuel bed;
(4) means for cycling incompletely combusted volitiles from said first combustion chamber to said second combustion chamber wherein the volitiles are completely combusted, and
(5) means for exhausting completely combusted volitiles; and
b. a boiler unit contiguously arranged with respect to said combustion unit, said boiler unit having;
(1) at least one boiler drum with heat exchange tubes for generation of steam;
(2) a first heat exchange chamber, wherein said tubes of said boiler are exposed in part, said means for cycling incompletely combusted volitiles including means for cycling said volitiles through said first heat exchange chamber before cycling to said second combustion chamber, and
(3) a second heat exchange chamber wherein said tubes of said boiler are exposed in part, said means for exhausting completely combusted volitiles including means for exhausting said volitiles through said second heat exchange chamber;
wherein said first combustion chamber is constructed and arranged directly above said second combustion chamber, and adjacently contiguous to said first heat exchange chamber, and, said second heat exchange chamber is constructed and arranged directly below said first heat exchange chamber, and adjacently contiguous to said second combustion chamber.

4. The solid fuel plant of claim 3 wherein said boiler heat exchange tubes comprise free expansion tubes having a first part exposed in said first heat exchange chamber and a second part with a terminal end exposed in said second heat exchange chamber.

5. The solid fuel plant of claim 4 wherein said boiler is located above said first heat exchange chamber with vertically depending tubes penetrating said first and second heat exchange chambers.

6. The solid fuel plant of claim 5 wherein said first and second heat exchange chambers are separated by a horizontally disposed baffel.

7. The solid fuel plant of claim 3 including an air regulation circuit having means for regulating the supply of air to said combustion unit.

8. The solid fuel plant of claim 7 wherein said means for regulating the supply of air to said combustion unit includes means for preheating the air.

9. The solid fuel plant of claim 3 including structural frame means for integrating said combustion unit and said boiler unit into an integrated structure for unit transport to an operating site.

10. A low-profile solid fuel steam generation plant comprising in combination:
a. a combustion unit having:
(1) a first combustion chamber with a solid fuel bed for preliminary combustion of solid fuel, wherein incompletely combusted volitiles are generated within said first chamber;
(2) a second combustion chamber with an ash bed for complete combustion of combustible residuals of the solid fuel deposited from the first combustion chamber;
(3) means for depositing solid fuel on said solid fuel bed;
(4) means for cycling incompletely combusted volitiles from said first combustion chamber to said second combustion chamber wherein the volitiles are completely combusted, and
(5) means for exhausting completely combusted volitiles; and,
b. a boiler unit contiguously arranged with respect to said combustion unit, said boiler unit having:
(1) at least one boiler drum with heat exchange tubes for generation of steam;
(2) a first heat exchange chamber, wherein said tubes of said boiler are exposed in part, said means for cycling incompletely combusted volitiles including means for cycling said volitiles through said first heat exchange chamber before cycling to said second combustion chamber, and
(3) a second heat exchange chamber wherein said tubes of said boiler are exposed in part, said means for exhausting completely combusted volitiles including means for exhausting said volitiles through said second heat exchange chamber;
wherein said first and second heat exchangers are constructed and arranged above and below one another and said boiler tubes are continuous, each passing through said first and second heat exchangers.

* * * * *